US009605890B2

(12) United States Patent
Micka et al.

(10) Patent No.: US 9,605,890 B2
(45) Date of Patent: Mar. 28, 2017

(54) REVERSE CYCLE DEFROST METHOD AND APPARATUS

(75) Inventors: Joel Micka, Kennewick, WA (US); Mark Decker, Kennewick, WA (US)

(73) Assignee: JMC Ventilation/Refrigeration, LLC, Kennewick, WA (US)

( * ) Notice: Subject to any disclaimer, the term of this patent is extended or adjusted under 35 U.S.C. 154(b) by 878 days.

(21) Appl. No.: 13/174,650

(22) Filed: Jun. 30, 2011

(65) Prior Publication Data

US 2012/0102986 A1 May 3, 2012

Related U.S. Application Data

(60) Provisional application No. 61/360,313, filed on Jun. 30, 2010.

(51) Int. Cl.

| | |
|---|---|
| ***F25B 41/00*** | (2006.01) |
| ***F25D 21/12*** | (2006.01) |
| *F25B 47/02* | (2006.01) |
| *F25D 21/00* | (2006.01) |

(52) U.S. Cl.

CPC ..... *F25D 21/12* (2013.01); *F25B 47/02* (2013.01); *F25D 21/006* (2013.01); *F25D 2317/0684* (2013.01)

(58) Field of Classification Search

CPC .. F25D 21/12; F25D 21/02; F25D 2317/0684; F25D 21/006; F25B 47/02; F25B 47/025

USPC ..... 62/81, 82, 278, 151, 256, 153

See application file for complete search history.

(56) References Cited

U.S. PATENT DOCUMENTS

| | | | |
|---|---|---|---|
| 2,341,868 | A | 2/1944 | Hitchcock et al. |
| 2,347,265 | A | 4/1944 | Hyman |
| 2,435,056 | A | 1/1948 | Schomer et al. |
| 2,460,792 | A | 2/1949 | Pabst et al. |
| 2,510,839 | A | 6/1950 | Schmidl |
| 2,541,701 | A | 2/1951 | Karmen |
| 2,736,987 | A | 3/1956 | Tomasovich |

(Continued)

FOREIGN PATENT DOCUMENTS

| | | |
|---|---|---|
| GB | 1035316 | 7/1966 |
| GB | 1054405 | 1/1967 |

(Continued)

OTHER PUBLICATIONS

"Adjustable-Speed Drives for When the Cows Come Home", Power Transmission Design, Nov. 1978, pp. 58-62, vol. 19, No. 11, ISSN 0032-6070, ã Penton/IPC, Inc., Cleveland, OH.

(Continued)

*Primary Examiner* — Len Tran
*Assistant Examiner* — Ana Vazquez
(74) *Attorney, Agent, or Firm* — Perkins Coie LLP

(57) ABSTRACT

Systems and methods for refrigerating crops and other goods and for defrosting a refrigeration system. A refrigerant is circulated between a condenser and a refrigerator to cool air in the refrigerator. Heat is removed from the refrigerant at the condenser. Periodically the cycle of refrigerant and air can be reversed to melt frost in the refrigerator. Frost can be detected by a sensing mechanism and the refrigerant and air cycles can be reversed in response to detecting the frost. The frost can be removed quickly without removing the goods from the refrigerant.

30 Claims, 4 Drawing Sheets

(56) References Cited

U.S. PATENT DOCUMENTS

| | | | | |
|---|---|---|---|---|
| 2,850,615 | A | | 9/1958 | Luse, Jr. et al. |
| 2,894,845 | A | | 7/1959 | Stoddard |
| 2,978,333 | A | | 4/1961 | Teigen |
| 3,080,278 | A | | 3/1963 | Douros, Jr. et al. |
| 3,113,875 | A | | 12/1963 | Prater et al. |
| 3,128,170 | A | | 4/1964 | Plant |
| 3,245,250 | A | | 4/1966 | Parks, Jr. |
| 3,339,475 | A | | 9/1967 | Martin |
| 3,357,201 | A | | 12/1967 | Toyama |
| 3,607,316 | A | | 9/1971 | Hume |
| 3,633,825 | A | | 1/1972 | Waldron |
| 3,742,094 | A | | 6/1973 | Kishino et al. |
| 3,788,066 | A | | 1/1974 | Nebgen |
| 3,857,511 | A | | 12/1974 | Govindan |
| 3,879,188 | A | | 4/1975 | Fritz et al. |
| 3,884,161 | A | | 5/1975 | Ankersen |
| 3,884,163 | A | | 5/1975 | Ankersen |
| 3,913,661 | A | | 10/1975 | Burg et al. |
| 3,949,733 | A | | 4/1976 | Miller et al. |
| 3,978,235 | A | | 8/1976 | Schiro |
| 4,078,480 | A | | 3/1978 | Luck |
| 4,113,175 | A | | 9/1978 | Sutton, Jr. |
| 4,148,926 | A | | 4/1979 | Baker et al. |
| 4,148,927 | A | | 4/1979 | Baker et al. |
| 4,154,656 | A | | 5/1979 | Maurer |
| 4,167,584 | A | | 9/1979 | Nelson |
| 4,200,657 | A | | 4/1980 | Cook |
| 4,208,192 | A | | 6/1980 | Quigley et al. |
| 4,216,238 | A | | 8/1980 | Baker et al. |
| 4,226,179 | A | | 10/1980 | Sheldon, III et al. |
| 4,241,871 | A | | 12/1980 | Newell, III et al. |
| 4,250,898 | A | | 2/1981 | Utsch et al. |
| 4,266,179 | A | | 5/1981 | Hamm, Jr. |
| 4,270,358 | A | | 6/1981 | Husain et al. |
| 4,291,617 | A | | 9/1981 | Miller et al. |
| 4,332,137 | A | * | 6/1982 | Hayes, Jr. ..... 62/81 |
| 4,335,148 | A | | 6/1982 | Vidal et al. |
| 4,335,273 | A | | 6/1982 | Levin |
| 4,336,273 | A | | 6/1982 | Lee |
| 4,336,814 | A | | 6/1982 | Sykes et al. |
| 4,340,073 | A | | 7/1982 | de la Burde et al. |
| 4,351,849 | A | | 9/1982 | Meade |
| 4,377,599 | A | | 3/1983 | Willard, Sr. |
| 4,382,077 | A | | 5/1983 | Buchbinder |
| 4,388,892 | A | | 6/1983 | Rody et al. |
| 4,421,774 | A | | 12/1983 | Vidal et al. |
| 4,449,541 | A | | 5/1984 | Mays et al. |
| 4,479,079 | A | | 10/1984 | Hanner |
| 4,499,833 | A | | 2/1985 | Grantham |
| 4,532,156 | A | | 7/1985 | Everest-Todd |
| RE32,013 | E | | 10/1985 | de la Burde et al. |
| 4,568,019 | A | | 2/1986 | Browning |
| 4,570,532 | A | | 2/1986 | Labelle |
| 4,577,467 | A | * | 3/1986 | Ibrahim et al. ..... 62/82 |
| 4,622,119 | A | | 11/1986 | Cerkanowicz et al. |
| 4,636,336 | A | | 1/1987 | Gay et al. |
| 4,637,296 | A | | 1/1987 | Hirosaki et al. |
| 4,651,072 | A | | 3/1987 | Takata |
| 4,668,435 | A | | 5/1987 | Grantham |
| 4,686,094 | A | | 8/1987 | Roberts et al. |
| 4,704,134 | A | | 11/1987 | Meyer et al. |
| 4,735,134 | A | | 4/1988 | Brouwer |
| 4,743,436 | A | | 5/1988 | Lyon |
| 4,772,315 | A | | 9/1988 | Johnson et al. |
| 4,778,517 | A | | 10/1988 | Kopatz et al. |
| 4,802,915 | A | | 2/1989 | Kopatz et al. |
| 4,814,612 | A | | 3/1989 | Vestal et al. |
| 4,823,679 | A | | 4/1989 | Robbins |
| 4,844,721 | A | | 7/1989 | Cox et al. |
| 4,849,192 | A | | 7/1989 | Lyon |
| 4,859,237 | A | | 8/1989 | Johnson et al. |
| 4,876,802 | A | | 10/1989 | Gergely et al. |
| 4,887,525 | A | | 12/1989 | Morgan |
| 4,894,452 | A | | 1/1990 | Stephan |
| 4,911,930 | A | | 3/1990 | Gergely et al. |
| 4,927,456 | A | | 5/1990 | Kopatz et al. |
| 4,960,992 | A | | 10/1990 | Vestal et al. |
| 4,977,825 | A | | 12/1990 | Morgan |
| 4,986,469 | A | | 1/1991 | Sutton, Jr. |
| 5,009,152 | A | | 4/1991 | Morgan |
| 5,041,245 | A | | 8/1991 | Benado |
| 5,084,187 | A | | 1/1992 | Wilensky |
| 5,129,951 | A | | 7/1992 | Vaughn et al. |
| 5,139,562 | A | | 8/1992 | Vaughn et al. |
| 5,156,747 | A | | 10/1992 | Weber et al. |
| 5,167,838 | A | | 12/1992 | Wilensky |
| 5,170,727 | A | | 12/1992 | Nielsen |
| 5,171,455 | A | | 12/1992 | Wang et al. |
| 5,244,866 | A | | 9/1993 | Tayler |
| 5,277,707 | A | | 1/1994 | Munk et al. |
| 5,306,350 | A | | 4/1994 | Hoy et al. |
| 5,360,554 | A | | 11/1994 | Sloan et al. |
| 5,376,045 | A | | 12/1994 | Kiser |
| 5,389,389 | A | | 2/1995 | Beck |
| 5,391,390 | A | | 2/1995 | Leo |
| 5,395,455 | A | | 3/1995 | Scott et al. |
| 5,436,226 | A | | 7/1995 | Lulai et al. |
| 5,460,006 | A | | 10/1995 | Torimitsu |
| 5,460,009 | A | * | 10/1995 | Wills et al. ..... 62/180 |
| 5,505,875 | A | | 4/1996 | Beaujean et al. |
| 5,512,285 | A | | 4/1996 | Wilde |
| 5,601,865 | A | | 2/1997 | Fulger et al. |
| 5,622,912 | A | | 4/1997 | Riggle et al. |
| 5,635,452 | A | | 6/1997 | Lulai et al. |
| 5,711,211 | A | | 1/1998 | Ide et al. |
| 5,723,184 | A | | 3/1998 | Yamamoto |
| 5,811,372 | A | | 9/1998 | Riggle et al. |
| 5,918,537 | A | | 7/1999 | Forsythe et al. |
| 5,935,660 | A | | 8/1999 | Forsythe et al. |
| 5,946,922 | A | | 9/1999 | Viard et al. |
| 5,965,489 | A | | 10/1999 | Forsythe et al. |
| 5,969,606 | A | | 10/1999 | Reber et al. |
| 6,068,888 | A | | 5/2000 | Forsythe et al. |
| 6,171,561 | B1 | | 1/2001 | Williamson et al. |
| 6,310,004 | B1 | | 10/2001 | Forsythe et al. |
| 6,322,002 | B1 | | 11/2001 | Forsythe et al. |
| 6,541,054 | B2 | | 4/2003 | Forsythe et al. |
| 6,646,864 | B2 | | 11/2003 | Richardson |
| 6,723,364 | B1 | | 4/2004 | Bompeix et al. |
| 6,892,591 | B2 | | 5/2005 | Grossman et al. |
| 6,992,546 | B2 | | 1/2006 | Chiang et al. |
| 7,644,591 | B2 | | 1/2010 | Singh et al. |
| 2005/0137090 | A1 | | 6/2005 | Sardo |
| 2005/0138943 | A1 | * | 6/2005 | Alahyari et al. ..... 62/256 |
| 2005/0288184 | A1 | | 12/2005 | Keim et al. |
| 2006/0270561 | A1 | | 11/2006 | Keim et al. |
| 2007/0277539 | A1 | * | 12/2007 | Kim et al. ..... A47F 3/0447 62/153 |
| 2007/0290062 | A1 | | 12/2007 | Forsythe et al. |
| 2010/0179703 | A1 | | 7/2010 | Singh et al. |
| 2011/0082591 | A1 | | 4/2011 | Micka et al. |
| 2012/0012092 | A1 | | 1/2012 | Micka et al. |
| 2012/0102986 | A1 | | 5/2012 | Micka et al. |

FOREIGN PATENT DOCUMENTS

| | | | |
|---|---|---|---|
| GB | 2250200 | A | 6/1992 |
| GB | 2347609 | A | 9/2000 |
| NL | 1013911 | | 6/2000 |
| NL | 1011571 | A1 | 9/2000 |
| WO | WO-9509535 | A2 | 4/1995 |

OTHER PUBLICATIONS

"Advanced Sprout Application Technology", Information Sheet, publicly available Nov. 14, 2006, JMC Enterprises, Inc., Kennewick, WA.

"AMPLIFY™ Aerosol Grade Potato Sprout Inhibitor", Directions for Use, publicly available Nov. 14, 2006, Platte Chemical Co., Greeley, CO.

"Biox Aerosol", Product Data Sheet, Jun. 15, 1999, revised Mar. 18, 2005, Xeda International, France.

(56) References Cited

OTHER PUBLICATIONS

"Biox-C A Natural Sprout Inhibitor", Information and Directions for Use, publicly available Nov. 14, 2006, JMC Enterprises, Inc., Kennewick, WA.
"DECCO 271 Aerosol Potato Sprout Inhibitor", Directions for Use, publicly available Nov. 14, 2006, Cerexagri Inc., Monrovia, CA.
"Decco 273 Aerosol Potato Sprout Inhibitor", Product Data, reviewed by State of California Department of Pesticide Regulation Aug. 30, 1995, ELF Atochem North America, Inc., Monrovia, CA.
"DECCOSOL 408 An Adjuvant", Handling and Storage Precautions, publicly available Nov. 14, 2006, Cerexagri Inc., Monrovia, CA.
"Mint Oil", Product Data Sheet, Oct. 7, 2004, revised Mar. 15, 2005, Xeda International, France.
"New Product 'Vaporizes' Load Rejection Problems", Industry News, publicly available Nov. 14, 2006, D-I-1-4, Inc., Meridian, ID.
"New Product 'Vaporizes' Sprouting Problems", Industry News, publicly available Nov. 14, 2006, D-I-1-4, Inc., Meridian, ID.
"Potato Fan VFDs" Cascade Energy Engineering website, accessed Apr. 11, 2003, <http://www.cascadeenergy.com/cee_tool.cfm?app=energy_potatovfd_main>.
"Potato Storage Research Facility", University of Idaho Extension, page revised Mar. 31, 2003, <http://www.kimberly.uidaho.edu/potatoes.>.
"Potato Storage Research Shows Promise for Boosting Grower Profits", AgKnowledge, #169, publicly available Nov. 14, 2006, University of Idaho College of Agricultural and Life Sciences.
"Product Showcase", Potato Storage International, Jun. 2005, pp. 36-37.
"Specialty Product List", Pace International Webpage, Pace International LLC, accessed Aug. 8, 2008, <http://www.paceint.com/products.asp?prodid=4>.
"Speed Control of Fans During Application of Aerosol CIPC by Means of Frequency Adjustment of Fan Motor Supply Power", Apr. 15, 1988, Balivi Chemical Corporation, Boise, ID.
"Storage Chemicals Prove Answer for Challenge", reprinted from Potato Grower Magazine, Jan. 2003, vol. 32, No. 1.
"Talking Point", Potato Storage International, Mar. 2005, pp. 10-12.
"The Legendâ 1,4 SIGHT® Applicator", User Guide, publicly available Nov. 14, 2006, D-I-1-4, Inc., Meridian, ID.
"Thermal and ULV Fogging Equipment", Nixalite webpage, accessed Aug. 8, 2008, <http://www.nixalite.com>.
"Thermofogging Has Arrived!" Sep. 2005, Pace International, accessed Sep. 25, 2008, <http://www.paceint.com/news.asp?newsid=9>.
"Treatments by Fogging", XEDA International S.A. Virtual Market Place, accessed Aug. 8, 2008, <http://ww.virtualmarket.fruitlogistica.de>.
"Variable Frequency Drive", Wikipedia, accessed Jan. 11, 2008, <http://en.wikipedia.org/wiki/Variable-frequncy_drive>.
"Variable Frequency Drives", JMC Ventilation Refrigeration, LLC, ã2005 JMC.
"Ventilation Systems", Potato Storage, 1983, pp. 14-18.
"Welcome to Xeda Group Website", ã2004, accessed Aug. 8, 2008, <http://www.xeda.com/en/base.html>.
"Xeda Group Affiliates" Jul. 16, 2008, Xeda Group webpage, <http://www.xeda.com/en/base.html>.
"Xeda Group Agencies", Jul. 15, 2008, Xeda Group webpage, <http://www.xeda.com/en/base.html>.
"Xeda O (OPP)", Product Data Sheet, Jun. 14, 1999, revised Mar. 15, 2005, Xeda International, France.
"Xedamate 60", Product Data Sheet, Oct. 24, 2004, revised Mar. 15, 2005, Xeda International, France.
"Xedamine Aerosol 88 (DPA)", Product Data Sheet, Jun. 14, 2000, revised Apr. 4, 2006, Xeda International, France.
"Xedaquine Aerosol (Ethoxyquin)", Product Data Sheet, Dec. 12, 1997, revised Apr. 6, 2006, Xeda International, France.
"Xedaril D", Product Data Sheet, Nov. 11, 2004, revised Mar. 16, 2005, Xeda International, France.
"Xedazole Aerosol (TBZ)", Product Data Sheet, Mar. 6, 1999, revised Jun. 4, 2006, Xeda International, France.
"Xedol Aerosol (OPP)", Product Data Sheet, May 15, 2001, revised Sep. 29, 2005, Xeda International, France.
1,4SHIP® Controls Peeps and Sprouts while Extending Shelf Life, publicly available Nov. 14, 2006, D-I-1-4, Inc., Meridian, ID.
1,4SIGHT Aerosol Grade—Potato Dormancy Enhancer, Product Label, publicly available Nov. 14, 2006, D-I-1-4, Inc., Meridian, ID.
1,4SIGHT Aerosol Grade—Potato Dormancy Enhancer, Sample Label, publicly available Nov. 14, 2006, D-I-1-4, Inc., Meridian, ID.
1,4SIGHT® A Revolutionary Potato Dormancy Enhancer for Sprout Control, publicly available Nov. 14, 2006, D-I-1-4, Inc., Meridian, ID.
1,4SIGHT® The New World of Enhancing Potato Dormancy, Jul. 30, 1998—Pasco, WA, Aug. 5, 1998—Merrill, OR.
ABB ACS550 adjustable speed AC drive User's Manual, Diablosport Revision Update Instructions, publicly available Nov. 14, 2006.
Aerosol Grade Sprout Nip 7A Directions for Use, publicly available Nov. 14, 2006, PPG Industries.
Agricultural Chemical Usage Postharvest Applications—Apples and Potatoes, May 1998, United States Department of Agriculture, National Agricultural Statistics Service.
Agricultural Chemical Usage Postharvest Applications—Oats and Potatoes Summary, Mar. 2007, United States Department of Agriculture, National Agricultural Statistics Board.
Allen, John P. C., et al., "A New Cost Effective Variable Frequency Drive for Centrifugal Loads", Conference Record Industry Applications Society IEEE-IAS-1983, Eighteenth Annual Meeting of the IEEE Industry Applications Society, Oct. 3-7 1983, IEEE Catalog No. 83 CH1900-0, Library of Congress No. 80-640527.
Allen, Rich, "Frequency Drives Work, Evaluating Their Use for Potato Storage", Spudman, Jul. 1996, pp. 39-40.
Alvear, Sylvana de los Ángeles Soto, "Evaluación Dela Aplicación en Postcosecha del Funguicida 'Pyrimethanil' Vía Termonebulización en el Control de Botrytis Cinerea en Manzana CV. Fuji", publicly available Nov. 14, 2006, Universidad de Talca, (English Abstract Attached).
Amendment, U.S. Appl. No. 07/103,326, filed Jun. 21, 1988.
AMPLIFY™ Sprout Inhibitor, product label, approved Sep. 28, 1999, Platte Chemical Co., Greeley, CO.
Announcing "Puff" Superior Sprout Inhibiting Apolication Technology from VSC, Feb. 23, 2005, Vegetable Storage Controls.
Biox-C A Natural Sprout Inhibitor, Sep. 2003, JMC Enterprises, Inc., Kennewick, WA.
Bohl, William H. et al., "Variable Frequency Drive Fan Control for Potato Storage", The Spudvine, Nov. 2002, University of Idaho Extension, Blackfoot, ID.
Bucarey, Elizabet Carla Rosa Rosales, "Eficacia de Aplicación de los Fungicidas Fludioxonil, Thiabendazole y Pyrimethanil por Termonebulización ("Thermofogging") en Manzanas Red Delicious Sobre el Control de Botrytis Cinerea en Postcosecha", publicly available Nov. 14, 2006, Universidad de Talca, (English Abstract Attached).
Burton, W.G., "Suppression of Potato Sprouting in Buildings", publicly available Nov. 14, 2006, pp. 299-305.
CIPC 98A Aerosol Grade Potato Sprout Inhibitor, Product Label, publicly available Nov. 14, 2006, Aceto Agricultural Chemicals Corporation, Lake Success, NY.
Clean Crop Sprout Nip 7 Aerosol Precautionary Statements and Directions, publicly available Nov. 14, 2006, Platte Chemical Co., Greeley, CO.
Connors, Dennis P. et al., "Considerations in Applying Induction Motors with Solid State Adjustable Frequency Controllers", Oct. 3-7 1983, IEEE Paper No. PCI-82-2, Reliance Electric Company, Cleveland, OH.
Cornercroft Typhoon Storage Systems, sales pamphlet, publicly available Nov. 14, 2006.
Corsini, Dennis et al., "A Simplified Method for Determining Sprout-Inhibiting Levels of Chlorpropham (CIPC) in Potatoes", Journal of Agricultural Food Chemistry, 1978, pp. 990-991, vol. 26, No. 4, Published by the American Chemical Society.

(56) References Cited

OTHER PUBLICATIONS

Corsini, Dennis et al., "Changes in Chlorpropham residues in Stored Potatoes." 1979 (no month). American Journal of Potato Research, vol. 56 No. 1, p. 43.
Cuffe, Stafford S. et al., "A Variable Frequency AC Blower Drive Installation for Efficient and Accurate Control of Glass Tempering", IEEE Transactions on Industry Applications, pp. 1047-1052, Jul.-Aug. 1985, vol. IA-21, No. 4.
Decco 271 Aerosol Potato Sprout Inhibitor, Sample Precautionary Statements and Directions for Use, publicly available Nov. 14, 2006, Cerexagri Inc., Monrovia, CA.
Decco 271 Aerosol, Product Lable, publicly available Nov. 14, 2006, ELF Atochem North America, Inc., Monrovia, CA.
Declaration of Joel Micka in Support of Defendants' Claim Construction Brief, Case No. 1:07-cv-00353-BLW, United States District Court for the District of Idaho, May 6, 2008.
DeEll, Jennifer, "Research Updates from the 9th International Controlled Admosphere Research Conference", Aug. 15, 2005, Ontario Ministry of Agriculture Food and Rural Affairs, accessed Sep. 25, 2008 <http://www.omafra.gov.on.ca/english/crops/hort/news/orchnews/2005/on_0805a9.htm>.
Duke, Russell A., Chemical Sampling of Puff and Leco Chlorpropham Application Processes, Jun. 13, 1995, Prepared for Larry Koppes Vegetable Storage Controls.
Energy-Efficient Electric Motors: Their Control and Application Symposium Proceedings, Feb. 23, 1983, Bonneville Power Administration, Portland, OR.
Environmental Protection Agency Application for Pesticide and Certification with Respect to Compliance with PR Notice 98-10, Product Name CIPC 98A, May 8, 2003.
Environmental Protection Agency Notice of Pesticide Registration, Decco 270 Aerosol, Aug. 8, 1995.
Farm Energy Centre, "Controlling Condensation in Potato Stoes," Jan. 1999, retrieved from the internet URL: http://www.fecservices.co.uk/DynamicContent/Documents/tech%20pubs/TN69%20Controlling%20condensation%20in%20potato%20stores.pdf.
Forbush, T.D. et al., "Sensing, Monitoring and Controlling Potato Storage Environments—A Process Report", for presentation at the 1987 Summer Meeting of the American Society of Agricultural Engineers, Baltimore Convention Center, Baltimore, MD, Jun. 28-Jul. 1, 1987.
Frazier, Mary Jo et al., "Organic and Alternative Methods for Potato Sprout Control in Storage," Univeristy of Idaho Extension, Idaho Agricultural Experiment Station, Sep. 2004, Ó2004 University of Idaho.
Frazier, Mary Jo et al., Clove Oil for Potato Sprout and Silver Scurf Suppression in Storage, Presented at the Idaho Potato Conference on Jan. 19, 2006, University of Idaho.
Get More Than Sprout Control 1,4 Sight®, publicly available Nov. 14, 2006, D-I-1-4, Inc., Meridian, ID.
Good Fruit Grower, 2008, Issue 11, Good Fruit Magazine: Postharvest, accessed Oct. 12, 2008, accessed Oct. 12, 2008, <http://www.goodfruit.com/issues.php?article=329&issue=11>.
Graves, Bruce, "The Selection and Application of NEMA Frame Motors for Use with Adjustable Frequency Drives", Conference Record of 1984 Annual Pulp and Paper Industry Technical Conference, Jun. 19-22, 1984, ISSN 0190-2172, ã1984 by the Institute of Electrical and Electronics Engineers, Inc.
Gray, Gleason et al., "Equipment for Chemical Treatment of Potatoes Moving Into Storage", Research in the Life Sciences, Jul. 1975, pp. 1-11, vol. 23, No. 3, Univeristy of Maine at Orono Life Sciences and Agriculture Experiment Station.
Grow Profits Not Sprouts, © 2004 Aceto Agricultural Chemical Corporation.
Hanson, B. et al., "Performance of Electric Irrigation Pumping Plants Using Variable Frequency Drives", Journal of Irrigation and Drainage Engineering, May-Jun. 1996, pp. 179-182, vol. 122, No. 3, American Society of Civil Engineers Water Resources Engineering Division.
Hanson, B. et al., "Variable-Frequency Drives for Electric Irrigation Pumping Plants Save Energy", California Agriculture Magazine,, Jan.-Feb. 1996, pp. 36-39, vol. 50, No. 1, University of California, Oakland, CA.
Heinze, P. H. et al., "Further Tests with 3-Chloro-Isopropyl-N-Phenyl Carbamate as a Sprout Inhibitor for Potato Tubers", American Potato Journal, vol. 32, pp. 357-361, Jan.-Dec. 1955.
Helmick, C. G., "Applying the Adjustable-Frequency Drive", EC&M, Sep. 1987, pp. 59-63.
Helmke, Dennis R., "A-C Adjustable Frequency Motor Control for Process Pumping Systems", Instrumentation in Food, Water, and Wastewater Industries: Instrumentation for People, May 1980, pp. 39-43, programmed by ISA's Industries & Sciences Department's Divisions—Food Industry , Water and Wastewater Industries, ã ISA 1980, ISBN: 87664-472-8.
Hirnyck, Ronda, et al., "Pest Management Strategic Plan for Pacific Northwest Potato Production—Revision", Jul. 13, 2007, Summary of a workshop held on Jan. 26, 2006, Western Integrated Pest Management Center, Pocatello, ID.
International Search Report, International Application No. PCT/US94/11419, issued Dec. 5, 1994.
Johnson, G.A., "A Retrofit Accomplishment: From Constant Air to Variable, Alternative Airflow Control Techniques and Variable Speed Drive Help Convert Single-Zone Constant Volume to Single-Zone Variable Air Volume System", Ashrae Journal, Jan. 1985, pp. 106-114, vol. 27, No. 1, ISSN-0001-2491, ã 1985 by the American Society of Heating, Refrigerating and Air Conditioning Engineers, Atlanta, GA.
Keim, W.A., "Aerosol Formulations for Thermal Aerosol Generators", Pesticide Formulations and Application Systems, 1996, vol. 16, ASTM STP 1312, Michael J. Hopkinson, Herbert M. Collins, G. Robert Goss, Eds., American Society for Testing and Materials.
Keim, W.A., Sprout Nip Aerosol Application Field Handbook, Apr. 7, 1987.
Kim, Mie-Soon Lee et al., "Effects of Chloropropham (CIPC) on Sprouting of Individual Potato Eyes and on Plant Emergence", American Potato Journal, 1972, pp. 420-431, vol. 49.
Kleinkopf, Gale E. and Mary Jo Frazier, "Alternative Sprout Suppressants for Stored Potatoes," Idaho Potato Conference, Jan. 23, 2002.
Kleinkopf, Gale et al., "Progress Report for Project BJ-K812", Methods for Sprout and Disease Suppression of Potatoes in Storage, publicly available Nov. 14, 2006, UI Kimberly R&E, Kimberly, ID.
Kleinkopf, Gale et al., "Progress Report Project BJ-K912", Methods for Sprout and Disease Suppression of Potatoes in Storage, publicly available Nov. 14, 2006, UI Kimberly R&E, Kimberly, ID.
Koski, Steve et al., Potato Fan VFDs Phase 2 Report, Oct. 2003, prepared for Northwest Energy Efficiency Alliance, Portland, OR.
Koski, Steve, "VFD Application in Onion Storages", Onion Storage VFDs, revised May 20, 2003, pp. 1-2, Cascade Energy Engineering.
Kupferman, Eugene et al., "Managing Storage Scald in Anjou Pears", Final Project Report , WTFRC Project No. PR-06-603, publicly available after Jan. 4, 2007, Washington State University Tree Fruit Research and Extension Center, Wenatchee, WA.
Leco Potato Fogger Fog Generator Instruction Manual and Parts List, ã1989, 1992, Lowndes Engineering Co., Inc., Valdosta, GA.
Lemeronde, Corey, "VFDs Speed Production, Ease Maintenance for RMG/FELM Wire Processing Customers", Drives Mag, ã1997-2004 DrivesMag.com, accessed Aug. 2, 2004, <http://www.drivesurvey.com/index_library.cfm?feature_id=96>.
Letter from Frank J. Dykas to Phil Hagenah, regarding Novelty Search Sprout Inhibitor, dated Feb. 24, 1988.
Letter from J.E. Jensen to W.R. Neilson, regarding Sprout Nip® 7A Research, dated Jul. 8, 1985.
Letter from Mike Frelleson to All Applicators regarding University of Idaho Study, dated Dec. 21, 2004.
Letter from W.A. Keim to J.E. Jensen, regarding Sprout Nip Aerosol, dated May 22, 1985.
Lewis, M.D. et al., "Dimethylnapthalene and Diisopropylnaphthalene for Potato Sprout Control in Storage: 1. Application Methodology and Efficacy", American Potato Journal, 1997, pp. 183-197, vol. 74.

(56) References Cited

OTHER PUBLICATIONS

McClung, Bruce L., "A Closer Look at Adjustable Frequency Alternating Current Variable Speed Drive Systems", Proceedings of the First Annual Control Engineering Conference: held as Part of the Control Engineering Conference, 1982, pp. 169-171, published by Control Engineering.
Moggia, C. et al., "Effect of DPA Reapplication by Thermofogging on Scald Control in Apples" (English Abstract), Vicerrectoria Academica Direccion de Promamas de Investigacion, Journal No. 4, Universidad de Talca, accessed Oct. 12, 2008, <ftp://colbum.utalca.cl/Documentos/Diat/jornadas_investigacion/jornada_4/4taJornada.pdf>.
Moggia, Claudia et al., "Use of Thermofogging for DPA and Fungicides Applications in Chile", Washington Tree Fruit Postharvest Conference, Wenatchee, WA, Dec. 2-3, 2003, 2003 Proceedings, pp. 1-10.
Morgan, Charlie, "Using Technology to Reduce Sprouting", Potato Grower of Idaho, publicly available Nov. 14, 2006, pp. 6-7.
Morton, Robert D. et al., "Evaporator Fan Variable Frequency Drive Effects on Energy and Fruit Quality",16th Annual Postharvest Conference, Yakima, WA, Mar. 14-15, 2000, Yakima, WA, Washington State University Tree Fruit Research and Extension Center Postharvest Information Network, Wenatchee, WA.
Morton, Robert D. et al., "Evaporator Fan VFD Effects on Energy and Fruit Quality", publicly available Nov. 14, 2006, Cascade Energy Engineering.
Oberg, Nathan A., et al., "Impact of Ventilation System Operation on Stored Potato Quality, Shrinkage and Engery Use Efficiency", Presented at the Idaho Potato Conference on Jan. 22, 2003.
Office Action, U.S. Appl. No. 07/103,326, dated Jun. 14, 1990.
Office Action, U.S. Appl. No. 07/103,326, mailed Mar. 21, 1988.
Olsen, Nora et al., Biox-C 2004 Research Summary, publicly available Nov. 14, 2006, University of Idaho, Kimberly, ID.
Papez, J.S., "Adjustable Flow with Adjustable Frequency", Power Transmission Design, Nov. 1978, pp. 58-62, vol. 19, No. 11, ISSN 0032-6070, ã Penton/IPC, Inc., Cleveland, OH.
Pin Nip 7A Aerosol Grade Potato Sprout Inhibitor Directions for Use, publicly available Nov. 14, 2006, Pin Nip, Inc., Boise, ID.
PIN NIP® Enjoy Solid Success in Sprout Control Technology, publicly available Nov. 14, 2006, PIN/NIP, Inc., Meridian, ID.
Pin Nipâ 98.6% Chlorpropham Aerosol Grade Potato Sprout Inhibitor Directions for Use, publicly available Nov. 14, 2006, Pin Nip, Inc., Boise, ID.
Pin Nip™ 98.6% Chlorpropham, Label and Directions for Use, Oct. 7, 1997.
Potato Fan VFDs 'Can VFDs Boost My Bottom Line?', publicly available Nov. 14, 2006, published with support from the University of Idaho, Northwest Energy Efficiency Alliance, and Cascade Energy Engineering.
Potato Fan VFDs Phase 1 General Report, revised May 23, 2002, prepared by Cascade Energy Engineering, Inc., Walla Walla, WA.
Problems in the Use of Sprout Inhibitors, pp. 42-47, publicly available Nov. 14, 2006.
Process for Inhibiting Sprouting of Stored Potatoes, Preliminary Draft, Sep. 10, 1987.
Professor Profile for Nora L. Olsen, Extension Potato Specialist and Associate Extension Professor, University of Idaho, Idaho Center for Potato Research and Education, accessed Nov. 27, 2007, <http://www.ag.uidaho.edu/potato/people/olsen.htm>.
Rastovski, A. et al., "Sugars and Starch During Tuberization, Storage and Sprouting", Storage of Potatoes Post-Harvest Behavior, Store Design, Storage Practice, Handling, 1981, pp. 82-96, Centre for Agricultural Publishing and Documentation, Wageningen.
Relief for Sprouting and Pressure Bruise, publicly available Nov. 14, 2006, One Four Group, Meridian, ID.
Reregistration Eligibility Decision (RED) Letter for Chlorpropham, Environmental Protection Agency, Prevention, Pesticides, and Toxic Substances, Oct. 1996.
Roemhildt, David, "Sprout Inhibiting: New Product Reduces Tuber Stress", Potato Country, Sep. 1995, pp. 14-15.
Salyani, M. et al., "Deposition Efficiency of Different Droplet Sizes for Citrus Spraying", Transactions of the ASAE, Nov.-Dec. 1987, pp. 1595-1599, vol. 30, No. 6, ã 1987 American Society of Agricultural Engineers.
Sample Application Program—Norkotah, Ranger, or Chipper, publicly available Nov. 14, 2006, One Four Group, Meridian, ID.
Sawyer, R. L., "Relation of Chloro IPC for Potato Sprout Inhibition to Internal Sprouting of Potatoes", American Potato Journal, vol. 38, pp. 203-207, Jan.-Dec. 1961.
Sawyer, R.L. et al., "Vaporized Chemical Inhibitors and Irradiation, Two New Methods of Sprout Control for Tuber and Bulb Crops", Proceedings of the American Society for Horticultural Science, Jun. 1956, pp. 516-521, vol. 67, Published by The Society, Cornell University, Ithaca, NY.
Scholey, Douglas, "Induction Motors for Variable Frequency Power Supplies", IEEE Transactions on Industry Applications, Jul.-Aug. 1982, pp. 368-372, vol. IA-18, No. 4.
Selke, Gregory H., "Future Trends in Applications and Marketing of Adjustable Frequency A.C. Motor Drives", Proceedings of the Third Annual Control Engineering Conference, Held as part of the Control Engineering Conference and Exposition, Rosemont, IL, May 22-24, 1984, pp. 83-88, ã1984 by the Technical Publishing Company.
Solowjow, Alex O., "Variable Fan-Speed Control . . . A Simple and Effective Method for Reducing Plant Energy Costs", Plant Engineering, Jan. 23, 1986, pp. 55-57, vol. 40, No. 2, ISSN 0032-082X, ã1986 by Technical Publishing, Barrington, IL.
Sprout Torch™ Potato Sprout Exterminator, Label Sample, transmitted via fax Mar. 11, 2005, 1,4GROUP, Inc., Meridian, ID.
Stringer, Loren F., "Synchonous Motor Adjustable Frequency Drive Systems for Large Mechanical-Draft Fans", Proceedings of the American Power Conference, 1980, pp. 488-500, vol. 42, ISSN UU97-2126, Illinois Institute of Technology, Chicago, IL.
Talk Tips for 1,4SHIP®, publicly available Nov. 14, 2006, D-I-1-4, Inc.
Tallant, Dennis, "Fanning the Cost of Energy" Telephone Engineer & Management, Feb. 15, 1981, pp. 100-104.
Techmark, Inc.'s Techlines, 2002, No. 1, Techmark, Inc., Lansing, MI.
Toshiba Transistorized PWM Inverter VF Pack-P1, 230V/460VClass 1-88kVA, Technical Data, Jan. 1987.
Urano, A.S. et al., "System Benefits and Considerations When Using AC Adjustable-Frequncy Drives in Generating Stations", Proceedings of the American Power Conference, 1981, pp. 515-528, vol. 43, Illinois Institute of Technology, Chicago, IL.
Wilcox, Marcus H. et al., "The Evaporator Fan VFD Initiative", 14th Annual Postharvest Conference, Yakima, WA, Mar. 10-11, 1998, Washington State University Tree Fruit Research and Extension Center Postharvest Information Network, Wenatchee, WA.
Wilson, D. M., Prairie Potato Council , Feb. 15, 1983.
Wilson, J.B. et al., "Airflow Effect on Distribution of Isopropyl N-(3-Chlorophenyl) Carbamate (Chloro-IPC) Applied to Bulk Bins of Potatoes", American Potato Journal, vol. 42, No. 1, pp. 1-6, Jan. 1965.
Xu et al., "Modeling the Application of Chemicals in Box Potato Stores." 2000 (no month). Pest Management Sciences. vol. 56, pp. 111-119.
Yost, John C., Jr. et al., "Experiences with Adjustable Frequency Fan Drives", Proceedings of the 1983 16th Annual Frontiers of Power Conference, Oct. 10-11, 1983, pp. III-1-III-4, Oklahoma State University, Stillwater, OK.
Final Office Action; U.S. Appl. No. 11/940,275, mailed on Aug. 4, 2011, 28 pages.
Non-Final Office Action; U.S. Appl. No. 13/174,650, mailed on Mar. 21, 2014, 9 pages.
Non-Final Office Action; U.S. Appl. No. 11/940,275, mailed on Nov. 26, 2010, 15 pages.
Non-Final Office Action; U.S. Appl. No. 12/859,759, mailed on Dec. 28, 2012, 10 pages.
Notice of Allowance; U.S. Appl. No. 11/940,275, mailed on Mar. 9, 2012, 11 pages.

* cited by examiner

REVERSE CYCLE DEFROST METHOD AND APPARATUS

CROSS-REFERENCE TO RELATED APPLICATION

The present application claims priority under 35 U.S.C. §119(e) of U.S. Provisional Application No. 61/360,313, filed Jun. 30, 2010, the disclosure of which is incorporated herein by reference in its entirety.

TECHNICAL FIELD

The following disclosure relates generally to refrigeration devices, systems and methods including variable-frequency drive air pressurizing units for operating and defrosting refrigeration units.

BACKGROUND

Refrigeration is essential to maintaining freshness of crops and other perishable goods. As with any refrigeration units, frost build-up can reduce the efficiency of refrigeration units. As refrigeration units are opened and closed during normal use, water vapor from ambient air enters the refrigerator, condenses, and eventually freezes. The frost inhibits heat transfer into and out of the refrigeration unit, lowering efficiency. The frost can also accumulate on the refrigerated goods and damage them. In the extreme case, excessive moisture accumulation can reduce the efficiency to such a degree that the refrigeration unit is inoperable. Defrosting a refrigeration unit, however, can be difficult and inconvenient. One approach is to empty the unit and let ambient air melt the frost. This, however, requires that the goods be moved and stored while the frost melts. An alternative method is to melt the frost without removing the goods from the unit, but this process must be fast enough that the goods are not harmed by the heat applied to melt the frost. An improved defrost cycle can improve the efficiency of a refrigeration unit and thus the profitability of an enterprise.

DETAILED DESCRIPTION

Figure 1:
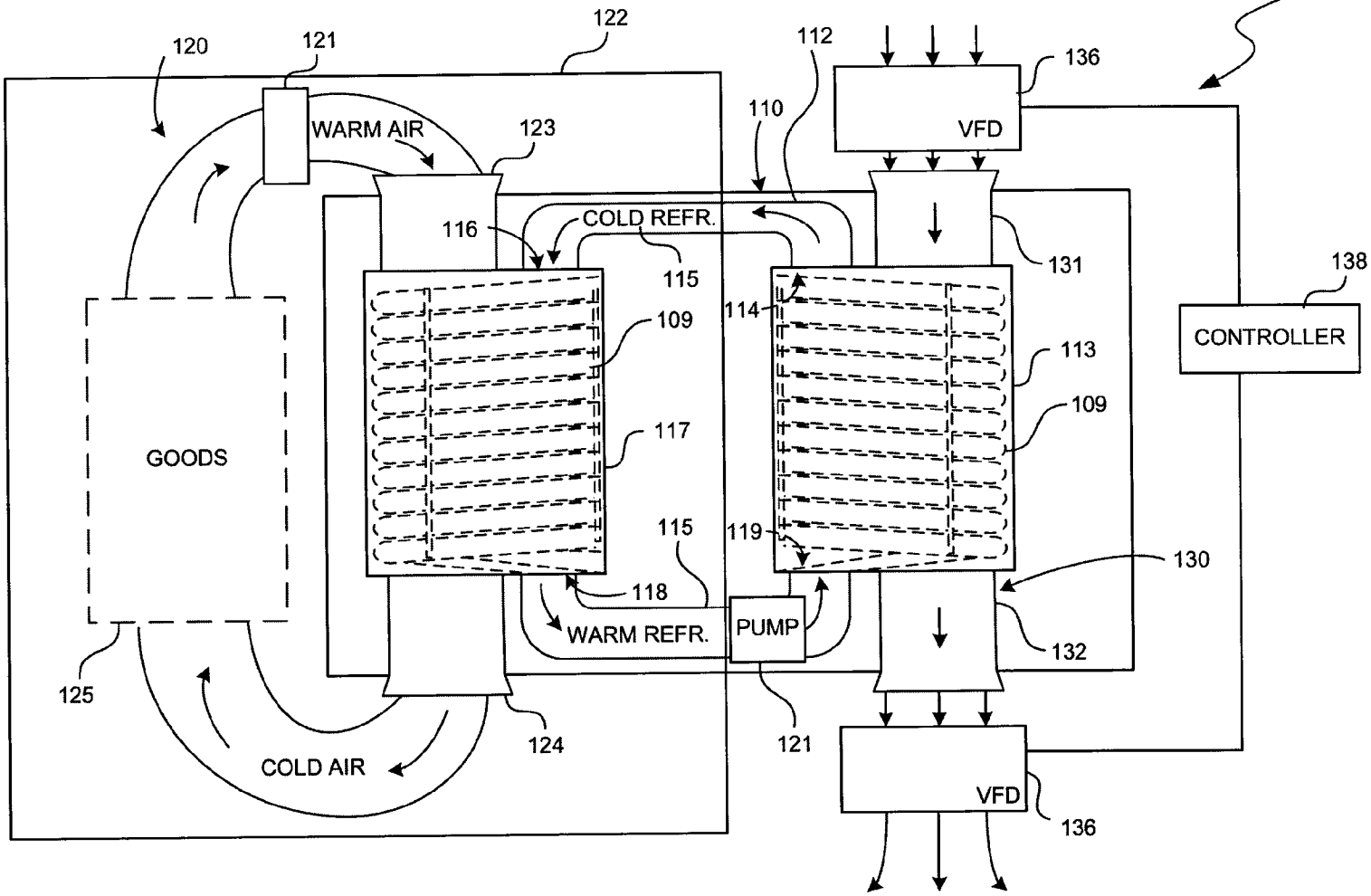
FIG. 1 is a partially schematic illustration of a refrigeration cycle configured according to the present disclosure.

The present disclosure is directed generally to apparatuses, devices, and associated methods for defrosting a refrigeration unit. In particular, the present disclosure is directed to defrosting apparatuses and methods for a crop storage facility or other large-scale storage operation. For example, the present disclosure is directed to a method of defrosting a crop storage facility refrigeration unit. The method can include refrigerating crops in a refrigerator by moving air in a first air direction for refrigeration and moving refrigerant in a first refrigerant direction for refrigeration. During normal use, the refrigeration unit may accumulate frost. The method can include detecting the frost in the refrigeration unit, and in response to detecting frost, the method includes moving the air in a second air direction for defrost and moving the refrigerant in a second refrigerant direction for defrost with the goods remaining in the refrigeration unit. The first air direction is opposite the second air direction and the first refrigerant direction is opposite the second refrigerant direction. The method can also include detecting that the frost has been removed, and in response to detecting that the frost has been removed, moving air in the first air direction for refrigeration and moving refrigerant in the first refrigerant direction for refrigeration.

In other embodiments, the present disclosure is directed to a method including circulating a refrigerant between a condenser and a refrigerator in a first refrigerant circulation direction. The refrigerant absorbs heat in the refrigerator and heat is removed from the refrigerant in the condenser. The method can continue by circulating air between thermal contact with the refrigerant and with goods to be refrigerated in a first air circulation direction. The air is cooled by the refrigerant and is warmed by the goods. The method can further include passing external air over a portion of the condenser in a first direction to remove heat from the refrigerant using a variable fan drive. The method can still further include removing accumulated frost from the refrigerator by circulating the refrigerant in a second refrigerant circulation direction opposite the first refrigerant circulation direction, circulating the air in a second air circulation direction opposite the first air circulation direction, and passing the external air over a portion of the condenser in a second direction opposite the first direction.

In other embodiments, the present disclosure is directed to a refrigeration and defrosting system including a condenser and a refrigerator configured to store goods to be refrigerated. The system can include a refrigerant circulation path between the condenser and the refrigerator, and a pump positioned in the circulation path and configured to move refrigerant along the refrigerant circulation path in a first refrigerant circulation direction. The system can also include an internal air circulation mechanism in the refrigerator and configured to circulate air in the refrigerator in a first air circulation direction to cool the air through thermal contact with refrigerant in the refrigerator, and to direct the air over the goods to cool the goods. In some embodiments, the system can also include an external air circulation mechanism configured to intake external air and direct the external air over at least a portion of the condenser to remove heat from the refrigerant, and a controller operably coupled to the pump and to the internal air circulation mechanism. The controller can be configured to reverse operation of the pump and the internal air circulation mechanism to circulate the refrigerant along the refrigerant circulation path in a second refrigeration circulation direction opposite the first refrigerant circulation direction and to circulate the air in a second air circulation direction opposite the first air circulation direction to melt frost in the refrigerator.

Several details describing structures and processes that are well-known and often associated with storage facilities and air handling equipment are not set forth in the following description to avoid unnecessarily obscuring embodiments of the disclosure. Moreover, although the following disclosure sets forth several embodiments of the invention, other embodiments can have different configurations, arrangements, and/or components than those described herein without departing from the spirit or scope of the present disclosure. For example, other embodiments may have additional elements, or they may lack one or more of the elements described below with reference to FIGS. 1-4.

Throughout this discussion, reference will be made to a crop storage facility for conciseness and clarity. It will be appreciated, however, that the disclosed systems and methods apply to refrigeration units for any other type of facility, including residential, industrial, and commercial buildings. The present disclosure also applies to air conditioning equipment and other cooling methods and apparatuses that are designed for general air-handling and not necessarily for storage and refrigeration.

Figure 2:
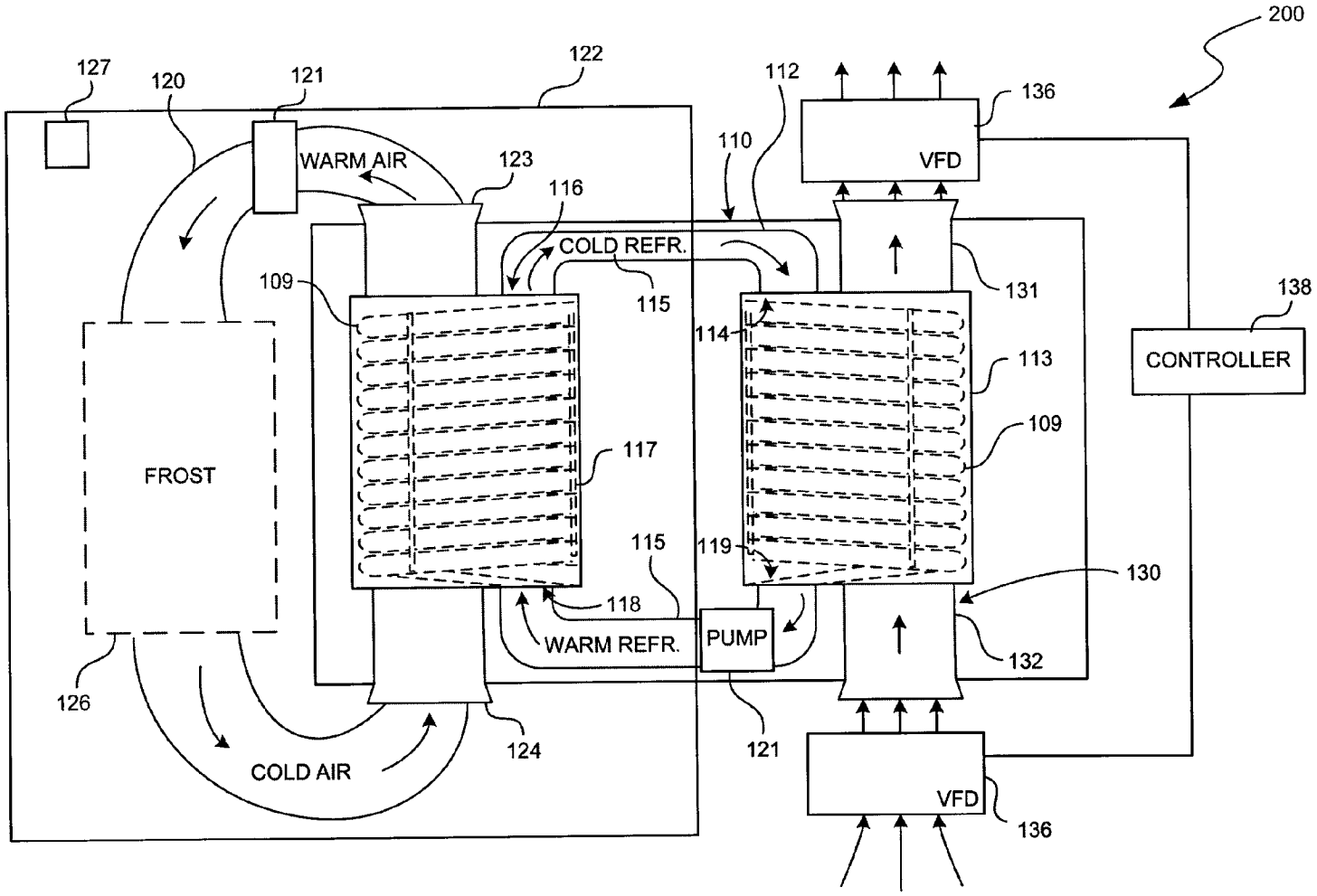
FIG. 2 is a partially schematic illustration of a defrost cycle configured according to the present disclosure.

FIG. 1 illustrates a partially schematic refrigeration cycle 100 according to the present disclosure. The refrigeration cycle 100 includes a fluid path 110 for refrigerant 112, a fluid path 120 for air inside a refrigeration unit 122, and a fluid path 130 for air external to the refrigeration unit 122. The fluid paths 110, 120, and 130 shown in FIGS. 1 and 2 are schematic. In operation, each fluid path can include multiple pipes, tubes, and other fluid directing means that are not necessarily shown in detail in FIGS. 1 and 2. These fluid paths 110, 120, and 130 intersect with one another at different portions of the cycle 100 to maintain a desired, cool temperature inside the refrigeration unit 122.

During the refrigeration cycle 100, the refrigerant 112 can move counter-clockwise from a condenser 113 through a first port 114, through a tube 115, and through a second port 116 into the refrigerator 117. The refrigerant 112 can exit the refrigerator 117 through a third port 118, through a tube 115, and back into the condenser 113 through a fourth port 119. A pump 121 can be used at any point along the fluid paths 110, 120, and 130 to pressurize the fluid. When the refrigerant 112 enters the condenser 113 it is warm and can be in a gas phase. The condenser 113 applies energy to the refrigerant 112 to cool the refrigerant 112 and, in some cases, to condense the refrigerant 112 back into a liquid phase according to thermodynamic principles. The cool, liquid refrigerant 112 is then cycled through the refrigerator 117 to cool the air in the refrigeration unit 122. The relatively warm air in the refrigeration unit 122 warms the refrigerant 122 and, in some cases, boils the refrigerant 112 into a gas. The refrigerant 112 can be a refrigerant such as R-134a or any other suitable refrigerant. Within the refrigeration unit 122, warm air is cycled to the refrigerator 117 through a fifth port 123, and in thermal contact with the refrigerant 112 to cool the air. The refrigerator 117 and the condenser 113 can include coils 109, or any other means for increasing heat transfer between fluids such as baffles or agitators, etc. The cold air leaves the refrigerator 117 through a sixth port 124 and is cycled over goods 125. The goods 125 can be anything to be refrigerated by the cycle 100. As the cold air from the refrigerator 117 contacts the relatively warm goods 125 it warms and then returns to the refrigerator 117. The principles of the present disclosure are applicable to all known refrigeration methods consistent with this disclosure.

To assist the condenser 113 with the process of removing heat from the refrigerant 112, fluid path 130 moves external air over the condenser 113. The air enters the condenser 113 through a seventh port 131 and leaves through an eighth port 132. In some embodiments, the external air is pressurized by a variable fan drive (VFD) 136. The refrigeration cycle 100 can include a separate VFD at the seventh port 131 and at the eighth port 132, or multiple VFDs 136 in various positions along the fluid path 130. The VFD 136 can include a user interface that enables an applicator (not shown) to control the speed and direction of air flow. The VFDs 136 can alter the throughput air with great accuracy and reliability. In other embodiments, the air flow can be reversed using DC motors, or a contactor switching between two power leads to a motor that drives fans. The air in the refrigeration unit 122 can also be circulated using a VFD.

In some embodiments, a controller 138 can manage these variables. The controller 138 can comprise a programmable logic controller (PLC) or other microprocessor-based industrial control system that communicates with components of the refrigeration unit 122 (or a series of coordinated refrigeration units 122) through data and/or signal links to control switching tasks, machine timing, process controls, data manipulation, etc. In this regard, the controller 138 can include one or more processors that operate in accordance with computer-executable instructions stored or distributed on computer-readable media. The computer-readable media can include magnetic and optically readable and removable computer discs, firmware such as chips (e.g., EEPROM chips), magnetic cassettes, tape drives, RAMs, ROMs, etc. Indeed, any medium for storing or transmitting computer-readable instructions and data may be employed. The controller 138 and embodiments thereof can be embodied in a special purpose computer or data processor that is specifically programmed, configured or constructed to perform one or more of the machine operations explained in detail below. Those of ordinary skill in the relevant art will appreciate, however, that the components of the refrigeration unit 122 can be controlled with other types of processing devices including, for example, multi-processor systems, microprocessor-based or programmable consumer electronics, network computers, and the like. Data structures and transmission of data and/or signals particular to various aspects of the controller 138 are also encompassed within the scope of the present disclosure.

Through normal use of the refrigeration unit 122, as in any refrigeration system, water vapor in the ambient air accumulates in the refrigeration unit 122. As the goods 125 are accessed, inevitably some air will enter the unit 122 bringing water vapor with it. When the water vapor contacts cold surfaces in the refrigeration unit 122 it may condense and freeze. Frost can form on any surface within the refrigeration unit and hampers the efficiency of the refrigeration unit 122.

FIG. 2 illustrates a defrost cycle 200 through which the frost and moisture build-up within the refrigeration unit 122 can be eliminated. In some embodiments, the components shown above with reference to the refrigeration cycle 100 can be substantially similar in the defrost cycle 200. The defrost cycle 200 is described herein with reference to similar components as the refrigeration cycle 100. To defrost the refrigeration unit 122, the flow of refrigerant 112 and air through fluid paths 110, 120, and 130 can be reversed. The refrigerant 112 can flow clock-wise from the condenser 113 through the fourth port 119 and into the refrigerator 117 through the third port 118. The refrigerant 112 is warm when it enters the refrigerator 117 and in turn warms the air in the refrigeration unit 122 enough to melt the frost 126. The refrigerant 112 leaves the refrigerator 117 from the second port 116 and returns to the condenser 113 cold and, in some cases, in a liquid state. The airflow 120 in the refrigeration unit 122 can also be reversed, flowing from the refrigerator 117 out of the fifth port 123, over the frost 126, and back into the refrigerator 117 through the sixth port 124. A pump 121 or fan can move the air.

The fluid flow 130 of external air over the condenser 113 can also be reversed. In selected embodiments, the fluid flow 130 can be reversed by reversing the direction of the VFDs 136. The VFDs 136 can include one or more fans—at least one in each direction—or they can include one or more bi-directional fans. In either case, the VFDs 136 can control the fans to change the direction of the fluid flow 130. In some cases, the reversed air flow can ensure that the liquid refrigerant 112 enters the refrigerator 117 in a gas phase (e.g., a vapor) to take advantage of the additional latent heat that accompanies a phase change. This additional heat is then applied to the air in the refrigerator 117 to melt the frost 126. The VFDs 136 can be manually operated to defrost the refrigeration unit 122, or the controllers 138 can automatically direct the defrost cycle 200 according to a schedule. In some embodiments, the refrigeration unit 122 can include a sensor 127 that can detect the presence of frost 126 and the controllers 138 can initiate a defrost cycle 200 in response to the sensor 127. The defrost cycle 200, including reversing fluid flows 110, 120, and 130, is faster, more efficient, and can operate at lower ambient temperatures than other defrost methods. Alternatively, the flow 120 can be stopped during the defrost cycle. For example, using the VFDs 136 to move the air, the refrigeration unit 122 can be defrosted rapidly enough to avoid harm to the goods 125 and, in some cases, without moving the goods 125 from the refrigeration unit 122.

Figure 3:
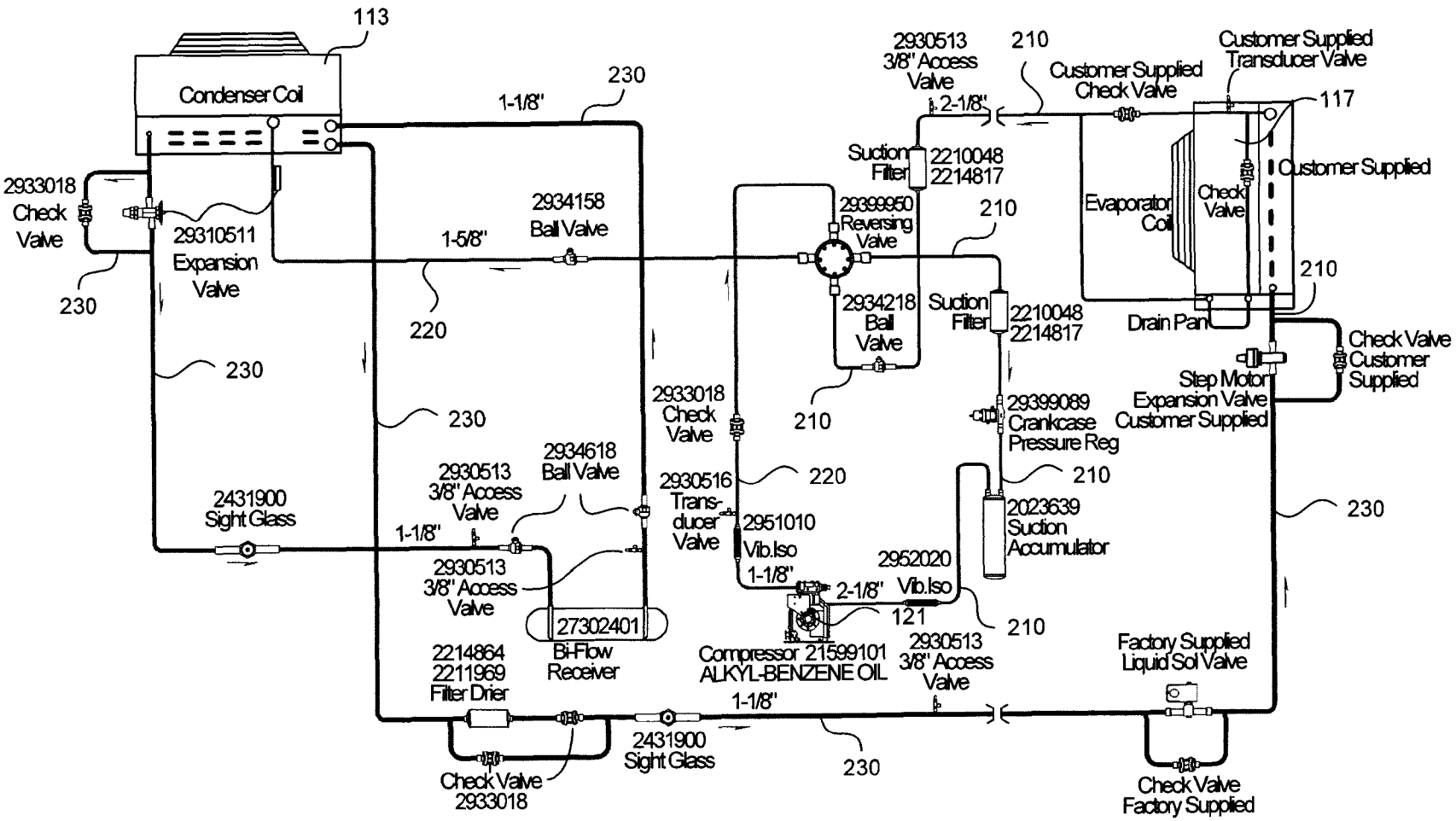
FIG. 3 illustrates a conceptual flow diagram of a cooling mode configured according to the present disclosure.
Figure 4:
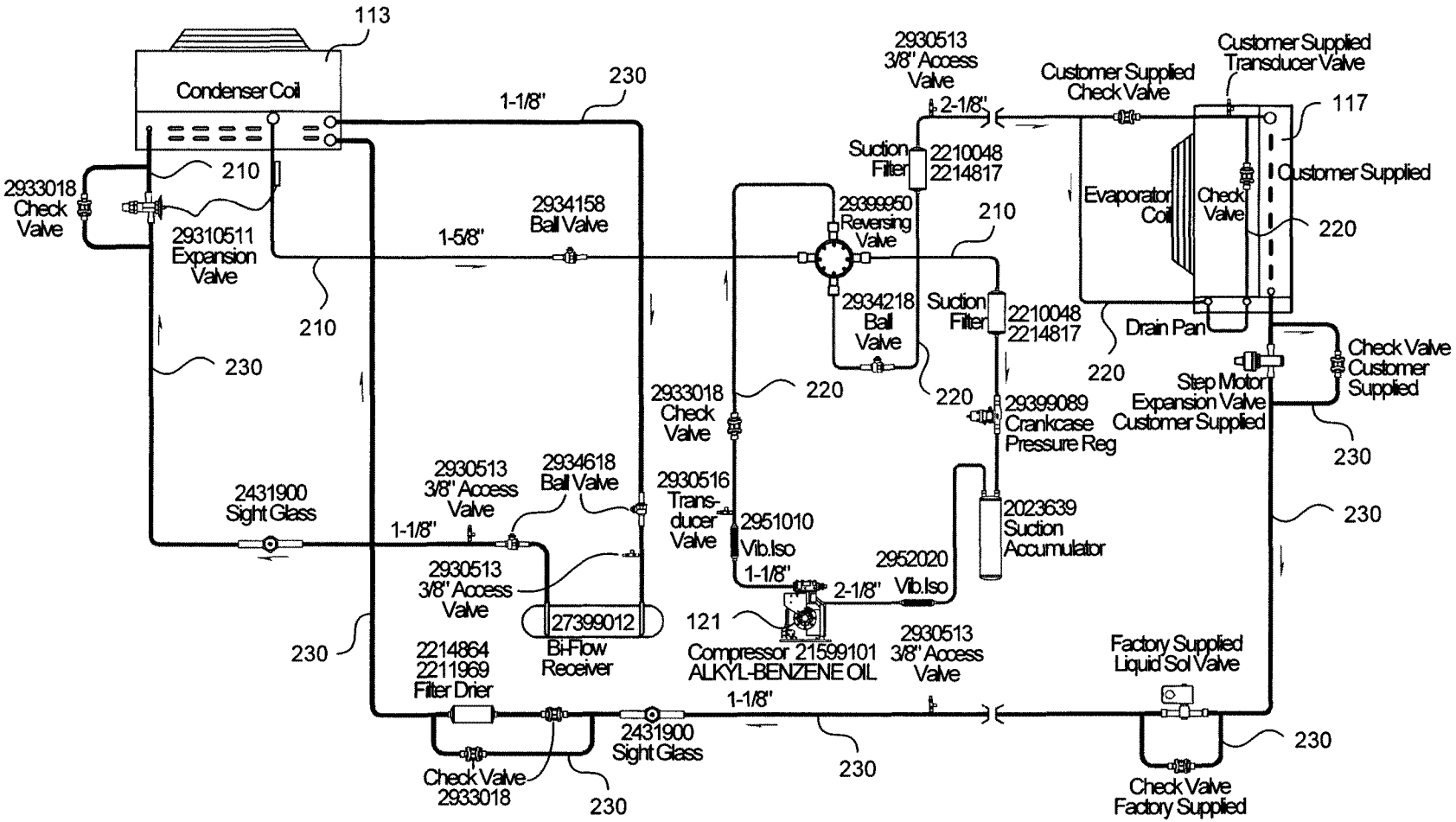
FIG. 4 illustrates a conceptual flow diagram of a defrost mode configured according to the present disclosure.

FIG. 3 illustrates a conceptual flow diagram of a cooling mode configured according to the present disclosure. The cooling mode includes a condenser 113, a refrigerator 117, and a compressor or pump 121. The flows include a suction line 210, a discharge line 220, and a liquid line 230. FIG. 4 illustrates a conceptual flow diagram of a defrost mode configured according to the present disclosure. The defrost mode includes a condenser 113, a refrigerator 117, and a compressor or pump 121. In the defrost mode, the flows 210, 220, and 230 are varied from the cooling mode according to the diagram.

From the foregoing, it will be appreciated that specific embodiments of the invention have been described herein for purposes of illustration, but that various modifications may be made without deviating from the spirit and scope of the various embodiments of the invention. Further, while various advantages associated with certain embodiments of the invention have been described above in the context of those embodiments, other embodiments may also exhibit such advantages, and not all embodiments need necessarily exhibit such advantages to fall within the scope of the invention. The following examples are directed to additional embodiments of the disclosure.

The invention claimed is:

1. A method of defrosting a crop storage facility refrigeration unit, the method comprising:

refrigerating perishable crops in the refrigeration unit by moving air over the crops hi a first air direction and moving refrigerant in a first refrigerant direction;

detecting frost in the refrigeration unit; and in response to detecting frost in the refrigeration unit, defrosting the refrigeration unit by moving the air over the crops in a second air direction and moving the refrigerant in a second refrigerant direction with the crops remaining in the refrigeration unit at a temperature sufficiently cool to avoid harm to the crops, wherein the first air direction is reverse with respect to the second air direction and the first refrigerant direction is reverse with respect to the second refrigerant direction.

2. The method of claim 1, further comprising detecting that the frost has been removed, and in response to detecting that the frost has been removed, refrigerating the crops in the refrigeration unit by moving air in the first air direction over the crops and moving refrigerant in the first refrigerant direction.

3. The method of claim 1 wherein refrigerating crops in the refrigeration unit by moving air comprises pressurizing the air with a variable fan drive.

4. The method of claim 1, further comprising:

directing external air into thermal contact with the refrigerant in a condenser to remove heat from the refrigerant by moving the external air in a first direction; and in response to detecting frost hi the refrigeration unit, moving the external air hi a second direction opposite the first direction.

5. The method of claim 1 wherein defrosting the refrigeration unit comprises moving the air from the first air direction to the second air direction using at least one of a variable fan drive, a DC electric motor, and contact switching between power leads of a fan motor.

6. The method of claim 1 wherein the refrigeration unit is in fluid communication with a condenser, and wherein the method further comprises:

flowing air over the condenser in a third air direction; and in response to detecting frost in the refrigeration unit, flowing air over the condenser in a fourth air direction opposite the third air direction.

7. The method of claim 6 wherein flowing air through the condenser in the third air direction includes operating a fan in a first mode to supply external air toward the condenser, and wherein flowing air through the condenser in the fourth air direction includes operating the fan in a second mode to receive air from the condenser.

8. The method of claim 6 wherein flowing air through the condenser in the third air direction includes operating a fan at a first mode to supply external air toward the condenser, and wherein flowing air through the condenser in the fourth air direction includes operating the fan at a second mode to exhaust air from the condenser.

9. The method of claim 8 wherein the fan includes a variable fan drive, and wherein flowing air through the condenser in the third air direction comprises pressurizing the air with the variable fan drive.

10. The method of claim 6, further comprising detecting that the frost has been removed, and in response to detecting that the frost has been removed, flowing air through the condenser in the third air direction and circulating the refrigerant through a conduit between the condenser and the refrigeration unit in the first refrigerant direction.

11. The method of claim 1 wherein defrosting the refrigeration unit includes increasing a temperature of the refrigeration unit from a first temperature to a second temperature, wherein operating the refrigeration unit at the second temperature melts at least a portion of the frost in the refrigeration unit without damaging the crops stored in the refrigeration unit.

12. The method of claim 1 wherein moving air over the crops in the first air direction comprises operating a fan in the refrigeration unit in a first fan direction, and wherein moving air over the crops in the second air direction comprises reversing the operation of the fan from the first fan direction to a second fan direction.

13. A method of operating a refrigeration unit having a condenser in fluid communication with a refrigerator, the method comprising:

refrigerating goods stored in the refrigerator, wherein refrigerating the goods includes— flowing air through the condenser in a first air direction; and circulating a refrigerant through a conduit between the condenser and the refrigerator in a first refrigerant direction, wherein the refrigerant absorbs heat in the refrigerator and dissipates heat in the condenser;

detecting frost in the refrigerator; and in response to detecting frost in the refrigerator, melting at least a portion of the frost without removing the goods from the refrigerator, wherein melting at least portion of the frost includes— flowing air through the condenser in a second air direction; and circulating the refrigerant through the conduit between the condenser and the refrigerator in a second refrigerant direction, wherein the second refrigerant direction is reversed with respect to the first refrigerant direction.

14. The method of claim 13 wherein melting at least a portion of the frost includes increasing a temperature of the refrigerator from a first temperature to a second temperature, wherein operating the refrigerator at the second temperature melts at least a portion of the frost in the refrigerator without damaging the goods stored in the refrigerator.

15. The method of claim 13 wherein flowing air through the condenser in the first air direction includes operating a fan at a first mode to supply external air toward the condenser, and wherein flowing air through the condenser in the second air direction includes operating the fan at a second mode to exhaust air from the condenser.

16. The method of claim 15 wherein the fan includes a variable fan drive, and wherein flowing air through the condenser in the first air direction comprises pressurizing the air with the variable fan drive.

17. The method of claim 13, further comprising detecting that the frost has been removed, and in response to detecting that the frost has been removed, flowing air through the condenser in the first air direction and circulating the refrigerant through the conduit between the condenser and the refrigerator in the first refrigerant direction.

18. A method of defrosting a crop storage facility refrigeration unit, the method comprising:

refrigerating crops in the refrigeration unit by moving air in a first air direction and moving refrigerant in a first refrigerant direction, wherein the refrigeration unit is in fluid communication with a condenser;

detecting frost in the refrigeration unit;

flowing air over the condenser in a second air direction; and in response to detecting frost in the refrigeration unit— defrosting the refrigeration unit by moving air in a third air direction and moving the refrigerant in a second refrigerant direction with the crops remaining in the refrigeration unit; and flowing air over the condenser in a fourth air direction opposite the second air direction, wherein the first air direction is opposite the third air direction and the first refrigerant direction is opposite the second refrigerant direction, wherein the condenser includes a first opening and a second opening, wherein the refrigeration unit further includes a first fan adjacent the first opening of the condenser and a second fan adjacent the second opening of the condenser, wherein flowing air over the condenser in the second air direction comprises operating the first fan in a first fan direction and operating the second fan in a second fan direction, and wherein flowing air over the condenser in the fourth air direction comprises operating the first fan in the second fan direction and operating the second fan in the first fan direction.

19. A method of defrosting a crop storage facility refrigeration unit, the method comprising:

refrigerating perishable goods in a refrigeration unit by moving air in a first air direction relative to the goods and moving refrigerant in a first refrigerant direction relative to a refrigerant conduit;

flowing air over a condenser coupled to the refrigeration unit in a first air direction relative to the condenser;

detecting frost in the refrigeration unit; and in response to detecting frost in the refrigeration unit:

defrosting the refrigeration unit by moving air in a second air direction relative to the goods, wherein the second air direction relative to the goods is reversed with respect to the first air direction relative to the goods;

flowing air over the condenser in a second air direction relative to the condenser, wherein the second air direction relative to the condenser is reversed with respect to the first air direction relative to the condenser; and moving refrigerant in a second refrigerant direction relative to the refrigerant conduit with the perishable goods remaining in the refrigeration unit, wherein the second refrigerant direction is reversed with respect to the first refrigerant direction.

20. The method of claim 19 wherein flowing air through the condenser in the first air direction relative to the condenser includes operating a fan in a first mode to supply external air toward the condenser, and wherein flowing air through the condenser in the second air direction relative to the condenser includes operating the fan in a second mode to receive air from the condenser.

21. The method of claim 19 wherein the condenser includes a first opening and a second opening, wherein the refrigeration unit further includes a first fan adjacent the first opening of the condenser and a second fan adjacent the second opening of the condenser, wherein flowing air over the condenser in the first air direction relative to the condenser comprises operating the first fan in a first fan direction and operating the second fan in a second fan direction, and wherein flowing air over the condenser in the second air direction relative to the condenser comprises operating the first fan in the second fan direction and operating the second fan in the first fan direction.

22. The method of claim 19 wherein flowing air through the condenser in the first air direction relative to the condenser includes operating a fan at a first mode to supply external air toward the condenser, and wherein flowing aft through the condenser in the second air direction includes operating the fan at a second mode to exhaust air from the condenser.

23. The method of claim 22 wherein the fan includes a variable fan drive, and wherein flowing air through the condenser in the first air direction relative to the condenser comprises pressurizing the air with the variable fan drive.

24. The method of claim 19, further comprising detecting that the frost has been removed, and in response to detecting that the frost has been removed, flowing air through the condenser in the first aft direction relative to the condenser and circulating the refrigerant through the refrigeration conduit between the condenser and the refrigeration unit in the first refrigerant direction.

25. A non-transitory computer-readable medium for operating a crop storage facility refrigeration unit configured to hold perishable goods, comprising instructions stored thereon, that when executed on a processor, perform the steps of:

moving air in the refrigeration unit in a first air direction relative to the goods and moving refrigerant in a first refrigerant direction relative to a refrigerant conduit;

flowing air through a condenser in a first air direction relative to the condenser, wherein the condenser is in fluid communication with the refrigeration unit via the refrigerant conduit;

detecting frost in the refrigeration unit; and in response to detecting frost in the refrigeration unit:

defrosting the refrigeration unit by moving air in a second air direction relative to the goods, wherein the second air direction relative to the goods is reversed with respect to the first air direction relative to the goods;

flowing air over the condenser in a second air direction relative to the condenser, wherein the second air direction relative to the condenser is reversed with respect to the first air direction relative to the goods; and moving the refrigerant in a second refrigerant direction relative to the refrigerant conduit with the perishable goods remaining in the refrigeration unit, wherein the second refrigerant direction is reversed with respect to the first refrigerant direction.

26. The computer-readable medium of claim 25 wherein the instructions stored thereon further comprise instructions for performing the steps of:

detecting that the frost has been at least partially removed; and in response to detecting that the frost has been at least partially removed, flowing air through the condenser in the first air direction relative to the condenser and circulating the refrigerant through the refrigeration conduit in the first refrigerant direction.

27. A method of defrosting a crop storage facility refrigeration unit, the method comprising:

receiving a flow of air into the refrigeration unit, the flow of air having a first air temperature and moving in a first air direction with respect to perishable crops stored in the refrigeration unit;

circulating refrigerant in the refrigeration unit in a first refrigerant direction;

detecting frost in the refrigeration unit; and in response to detecting frost in the refrigeration unit— reversing the flow of air from the first air direction to a second air direction with respect to the perishable crops, wherein the flow of air moving in the second air direction has a second air temperature greater than the first air temperature, and wherein the second air temperature is sufficiently low to avoid harm to the perishable crops; and reversing the circulation of refrigerant from the first refrigeration direction to a second refrigerant direction.

28. The method of claim 27, further comprising:

detecting that the frost has been removed from the refrigeration unit; and in response to detecting that the frost has been removed— receiving a new flow of air into the refrigeration unit, the new flow of air having the first air temperature and moving in the first air direction; and reversing the circulation of refrigerant from the second refrigerant direction to the first refrigerant direction.

29. The method of claim 27 wherein the second air direction is opposite the second refrigerant direction.

30. The method of claim 27 wherein receiving the flow of air into the refrigeration in the first air direction comprises operating a fan in the refrigeration unit in a first fan direction, and wherein reversing the flow air from the first air direction to the second air direction comprises reversing the operation of the fan from the first fan direction to a second fan direction.

* * * * *